United States Patent [19]

Falce

[11] Patent Number: 4,823,044

[45] Date of Patent: Apr. 18, 1989

[54] DISPENSER CATHODE AND METHOD OF MANUFACTURE THEREFOR

[75] Inventor: Louis R. Falce, Irvine, Calif.

[73] Assignee: Ceradyne, Inc., Costa Mesa, Calif.

[21] Appl. No.: 154,743

[22] Filed: Feb. 10, 1988

[51] Int. Cl.[4] ..... H01J 9/04

[52] U.S. Cl. ..... 313/346 DC; 313/346 R; 313/352

[58] Field of Search ..... 313/346 R, 346 DC, 355, 313/352, 630

[56] References Cited

U.S. PATENT DOCUMENTS

| | | | |
|---|---|---|---|
| 4,310,603 | 1/1982 | Falce | 313/355 X |
| 4,400,648 | 8/1983 | Taguchi et al. | 313/346 R |
| 4,417,173 | 11/1983 | Tuck et al. | 313/346 R |
| 4,570,099 | 2/1986 | Green | 313/346 R |
| 4,671,777 | 6/1987 | Van Esdonk | 313/346 DC |
| 4,737,679 | 4/1988 | Yamamoto et al. | 313/630 X |

*Primary Examiner*—David K. Moore
*Assistant Examiner*—Mark R. Powell
*Attorney, Agent, or Firm*—Leonard Tachner

[57] ABSTRACT

A four-piece, easily manufactured dispenser cathode capable of current densities up to and exceeding 10 Amperes per square centimeter is particularly adapted for CRT applications because of its surprisingly low cost. A refractory material reservoir contains a pellet of tungsten and barium calcium aluminate and is sealed by a pellet of porous tungsten or tungsten mixture. The reservoir/pellet assembly is contained in a support cylinder to which the porous tungsten pellet may be welded. The inventive process includes the steps to prepare the pellets and assemble the four elements of the cathode.

5 Claims, 1 Drawing Sheet

DISPENSER CATHODE AND METHOD OF MANUFACTURE THEREFOR

BACKGROUND OF THE INVENTION

1. Field of the Invention

This invention pertains generally to thermionic cathodes and more particularly, to reservoir-type dispenser cathodes that find particular advantageous application in devices such as cathode ray tubes requiring very high current density, that is, current densities greater than 10 amps per square centimeter of cathode surface area. The cathode of the present invention also finds advantageous application where current density requirements are less than 10 amps.

2. Prior Art

The most relevant prior art known to the applicant is U.S. Pat. No. 4,165,473 which discloses an improved cathode invented by the inventor of the present invention and which is assigned to Varian Associates, Inc. of Palo Alto, Calif. That patent discloses a dispenser cathode comprising a porous metal matrix consisting of a compacted mixture of tungsten and iridium particles impregated with a molten barium aluminate and other alkaline earth oxides which may be added to the matrix. The cathode structure disclosed in U.S. Pat. No. 4,164,473 is apparently primarily intended for use in microwave electron tubes designed for continuous wave operation such as a Klystron amplifier.

The prior art section of that patent adequately describes the previous attempts to provide cathodes capable of generating high current densities and indicates that generally the prior art limit of current density from such prior art attempts was about 3 amperes per square centimeter of cathode surface area. Furthermore, that patent reveals a structure which is capable of generating at least 10 amperes per square centimeter of cathode surface area thus providing a significant increase in power particularly at very high frequencies for use in microwave devices.

The dispenser cathode of the aforementioned patent was primarily intended for specialized microwave tubes which are generally very costly. Therefore, the high cost of manufacturing such cathodes was not at the time considered a major disadvantage. Dispenser cathodes costing as much as ten to twenty dollars to manufacture were not considered too expensive for their application in microwave tubes costing as much as thousands of dollars. On the other hand, thermionic cathodes designed for use in cathode ray tubes such as those used in computer terminals and displays and in certain TV monitors, have always been considered very cost sensitive because of the high volume and competitive nature of the ultimate product into which those cathodes are installed. Consequently, cathodes used in the prior art for such cost sensitive applications in cathode ray tubes have generally been of the type comprising an insulator semiconductor oxide cathode combination which is not capable of current densities greater than about 1 amp per square centimeter of cathode surface area, but which was still adequate for the relatively low current density applications of such prior art CRT devices.

Unfortunately, significant improvements in the computer art specifically related to display applications as well as other advances in cathode ray tube applications, have created a demand for a cathode for use in cathode ray tubes which is capable of achieving the high current densities of 10 amps per square centimeter or greater thereby making the dispenser-type cathode a highly desirable electron beam source for more recent cathode ray tube applications. However, the manufacturing costs of such dispenser cathodes continues to be about an order of magnitude higher than that which would be feasible in the highly competitive, cost sensitive cathode ray tube industry.

Thus there is now a need for a dispenser-type cathode which is capable of the aforementioned higher current densities but which may be manufactured for approximately 1/10 of the manufacturing costs of previously known high current density dispenser cathodes. Thus there are, in effect, two types of prior art to which the present invention may be compared. On the one hand there is the costly dispenser cathode prior art which is substantially unsuitable for application in cathode ray tubes because of the cost sensitivity of the ultimate product. On the other hand, there are the conventional cathodes that have previously found application in cathode ray tubes because of their relatively low cost but which are incapable of providing the high current densities that the more demanding applications require of today's cathode ray tubes.

The latter prior art, that is, prior art cathodes that have conventionally been used in cathode ray tubes, employ a nickel substrate with an impurity of magnesium or silicon as activators and which is coated with barium oxide, calcium oxide or strontium oxide applied as carbonates and which decompose to oxide during manufacture. Unfortunately, electron emission from such conventional cathode ray tube cathodes is far too limited for today's applications because the electron emission is induced from a semiconductor material and in order to increase the current density such materials require an extremely high voltage. Such high voltages applied for longer than a short pusle can cause arcing which is destructive to the cathode as a result of the charging effect of the material. The limit of current density therefore has usually been less than one amp per square centimeter for cathodes in CRT applications.

Previous attempts to substitute a metal cathode for the semiconductor cathode of the CRT art, such as the attempt described in the disclosure of U.S. Pat. No. 4,165,473, have been limited to metals that can survive a hydrogen atmosphere used during the impregnation step such as where tungsten is impregnated with barium aluminate or barium calcium aluminate or other earth metal additives.

SUMMARY OF THE INVENTION

The present invention comprises a novel dispenser cathode and method of manufacture providing an end product cathode which is capable of achieving the current densities of such prior art as disclosed in U.S. Pat. No. 4,165,473, but which employs a novel structure and manufacturing process permitting a significant reduction in cost on the order of one-tenth of the cost to manufacture prior art dispenser cathodes. Consequently, the present invention consists of a cathode which is cost competitive with the semiconductor-type cathodes of the CRT art but which provides an order of magnitude improvement in current density to meet the more modern demands of cathode ray tubes.

The cathode of the present invention utilizes a reservoir-type dispenser cathode structure that can be produced in four separate pieces and readily assembled at a relatively low cost. It permits inexpensive production methods using automated equipment of long proven use such as pill presses and punch presses. Furthermore, the structure of the present invention is more conducive to a uniform level of performance throughout the life of the cathode. This contrasts with prior art dispenser cathodes which generally have a significant degradation in performance over the life of the cathode because of the changes in the extent of evaporation of the alkali earth metal through the pores of the emissive metal. An important additional feature of the present invention is the uniformity of current density both short term and over the life of the cathode. The novel configuration of the inventive cathode structure, produces a uniform flow of barium from a reservoir enclosed pellet. This flow of barium passes through a pure tungsten enclosing pellet which is of a porous configuration. This porous, pure tungsten pellet needs no impregnation because the activating barium is derived entirely from the underlying enclosed pellet. This pure tungsten pellet and underlying barium source pellet configuration, prevents clogging of pores in the tungsten pellet and also prevents current density changes or patchiness both instantaneously and over the substantial life of the cathode.

The aforementioned four separate pieces of the present invention comprise a pressed and sintered porous tungsten pellet; a pressed pellet made of barium calcium aluminate and tungsten; a punched pressed reservoir formed of molybdenum, rhenium, a combination of molybdenum and rhenium, tantalum or other refractory metal; and a support cylinder in the form of an extrusion or similar processed structure formed of molybdenum, molybdenum-rhenium or tantalum.

The process of the present invention comprises the steps of pressing and sintering a pure tungsten pellet using tungsten powder of selected characteristics, punch pressing the reservoir form and forming the support cylinder, pressing a pellet of barium calcium aluminate and tungsten, assembling the reservoir and support cylinder, inserting the aluminate tungsten pellet into the reservoir, then sealing the porous, pure tungsten pellet to the top of the reservoir and cylinder assembly by either welding or brazing. The resultant cathode is designed to operate at approximately 850 to 1150 degrees Centigrade depending upon current density objectives. The pellet contained within the reservoir provides a constant low level of barium evaporation to activate the tungsten. More importantly, the cathode of the present invention provides the high current density of dispenser cathodes in a structural configuration which permits simple automated manufacture thereby significantly reducing the cost of rendering the invention compatible in cost with prior art current-density limited CRT cathodes.

OBJECTS OF THE INVENTION

It is therefore a principal object of the present invention to provide an improved dispenser cathode having a structure and manufacturing process associated with it that are conducive to costs comparable to conventional cathode ray tube cathode devices but that is capable of a current density of at least 10 amps per square centimeter of cathode emission surface area.

It is still an additional object of the present invention to provide an improved cathode and manufacturing process therefor in which a reservoir-type dispenser cathode can be produced in four separate pieces and readily assembled using automated equipment of long proven use.

It is still an additional object of the present invention to provide a dispenser cathode especially adapted for use as a high current density cathode ray tube cathode capable of generating a minimum of 10 amperes per square centimeter of cathode emission surface area by utilizing an emissive metal material but which is comparable in cost to semiconductor-type CRT cathodes of the prior art.

It is still an additional object of the present invention to provide a dispenser cathode having a reservoir enclosed barium source pellet and a reservoir enclosing pure, porous tungsten pellet, whereby the overlying pure tungsten pellet produces a uniform, non-patchy, high current density both instantaneously and over substantially the entire life of the cathode.

BRIEF DESCRIPTION OF THE DRAWINGS

The aforementioned objects and advantages of the present invention as well as additioal objects and advantages thereof will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
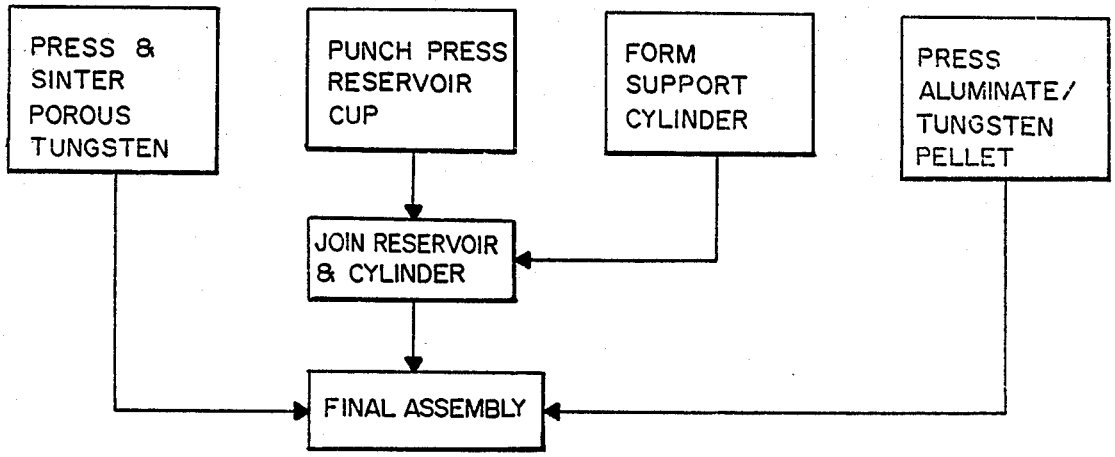
FIG. 1 is a block diagram representation of the manufacturing process of the present invention.
Figure 2:
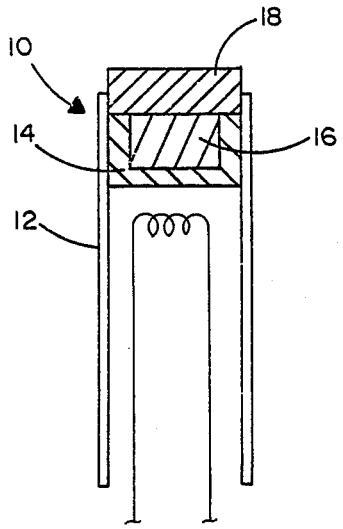
FIG. 2 is a cross-sectional view of the apparatus of the present invention.

Referring simultaneously to FIGS. 1 and 2 it will be seen that the present invention comprises an improved dispenser cathode 10 having a support cylinder 12 and a reservoir 14. The reservoir is substantially filled with a first pellet 16 comprising a mixture of tungsten and barium calcium aluminate. A second pellet 18 of pressed and sintered tungsten powder is brazed or welded to the support cylinder 12 thereby in effect sealing the reservoir 14 and the pellet 16 contained therein. Support cylinder 12 provides access to the sealed reservoir for a conventional heater such as that disclosed in U.S. Pat. No. 4,165,473. The reservoir 14 is received and supported by the interior wall surface of the support cylinder 12.

The manufacturing process of the preferred embodiment the present invention comprises the following steps:

1. Pressing and sintering a porous tungsten pellet of 70–80% density using powder from 4∝7 microns in diameter. The tungsten powder may optionally include 20–50% by weight of iridium, osmium, ruthenium or rhenium, however it is preferrable that this pellet be purely metal with no non-metal constituents which might otherwise clog pores and inimically affect current density uniformity;
2. forming a reservoir by punch pressing using either molybdenum, rhenium, molybdenum rhenium, tantalum, tungsten, tungsten rhenium or other refractory metal;
3. forming a support cylinder of molybdenum, rhenium, molybdenum-rhenium, tungsten, tungsten rhenium or tantalum by extrusion or similar process;
4. pressing pellets of barium calcium aluminate and tungsten wherein the tungsten constitutes between 20–50% of the mixture;
5. asembling the reservoir and support cylinder;
6. inserting the pellet of barium calcium aluminate and tungsten into the reservoir; and 7. sealing the porous tungsten pellet to the reservoir/-cylinder assembly by welding or brazing.

In one preferred embodiment of the process of manufacture, step No. 1 comprises first applying a uniaxial pressure of between 10,000 and 20,000 psi. to the tungsten to achieve a density of between 50–55% and then sintering the pressed tungsten at between 2,000 to 2,500 degrees Centigrade for between 30 and 60 minutes to achieve the 70–80% density. Furthermore, the reservoir forming process of step No. 2 was accomplished by using a simple die press. It should also be noted that although sealing step No. 7 of the process may use either welding or brazing, in the preferred embodiment of the process herein disclosed, welding appears to be a preferred form of sealing as compared to brazing.

The resultant dispenser cathode produced by the process hereinabove described and configured as shown in FIG. 2, is particularly advantageous as compared to the dispenser cathode of U.S. Pat. No. 4,165,473 for a number of reasons. Perhaps the most important such reason is the simplicity of the manufacturing process which greatly reduces the cost of manufacture as previously described. Furthermore, the porous tungsten pellet produced in step No. 1 has no clogged pores, that is, it has open pores that are not clogged by an extraneous material thereby making the metal portion of the cathode more efficient in its response to activation by the barium evaporation emanating from the emissive material contained within the reservoir. In fact, the only thing passing through the pores of the porous tungsten material in the upper pellet is barium or barium oxide emitted at a constant low level of barium evaporation, thereby assuring a substantially constant performance level throughout the life of the cathode.

The use of a pure metal pellet 18 is critical. First of all, any non-metal constituents such as barium calcium aluminate in this porous pellet, might otherwise clog the pores and would certainly detrimentally affect current density uniformity both instantaneously and over the life of the cathode. Secondly, significant depletion of material in the pellet 18 over a period of time would change the distance between the cathode's electron emitting surface and the G1 electrode in cathode ray tubes; a highly undesirable alteration to a usually critical parameter in CRTs.

It will now be understood that what has been disclosed herein comprises a novel improved dispenser cathode capable of generating high current densities which equal or exceed 10 amperes per square centimeter of cathode emission surface area. A novel configuration and a novel manufacturing process have been disclosed which result in a significant reduction in cost of manufacture as compared to prior art dispenser cathodes.

The present invention comprises an all metal dispenser cathode which improves the current density of the prior art cathodes normally used in cathode ray tubes by a factor of about 10 while at the same time providing a cathode which is cost comparable to the semiconductor cathodes of the prior art normally used in cathode ray tubes. The substantial reduction in manufacturing costs is obtained by utilizing a four piece assembly which may be readily produced by automated equipment thus providing the performance advantages of prior art dispenser cathodes but the cost advantages of lower current density semiconductor prior art cathodes normally used in cathode ray tubes.

Those having skill in the art to which the present invention pertains will now, as a result of the applicant's teaching herein, perceive various modifications and additions which may be made to the invention. By way of example, various modifications may be made to specific structure defined herein as well as to the specific steps of the process defined herein including the use of other ingredient components in the porous tungsten pellet as well as in the underlying emissive tungsten pellet with which barium calcium aluminate is combined in the reservoir of the present invention. However, it will be understood that all such modifications and additions are deemed to be within the scope of the invention which is to be limited only by the claims appended hereto.

I claim:

1. A dispenser cathode for cathode ray tubes comprising:

a reservoir formed of a refractory metal;

a first pellet contained within said reservoir formed by a mixture of about 50% to 80% barium calcium aluminate and about 20% to 50% tungsten;

a second pellet overlying and sealing said reservoir and comprising pressed and sintered porous tungsten; and means for applying heat to said reservoir and pellets for emitting current therefrom;

said second pellet having no non-metal constituents which could otherwise clog pores in said second pellet.

2. The cathode recited in claim 1 further comprising a support cylinder having an interior wall surface for receiving and supporting said reservoir.

3. The cathode recited in claim 1 wherein said reservoir is formed from a metal from the group consisting of molybdenum, rhenium, molybdenum and rhenium in combination, tungsten, tungsten and rhenium in combination and tantalum.

4. The cathode recited in claim 1 wherein said second pellet also comprises at least one metal of the group consisting of iridium, osmium, ruthenium and rhenium.

5. The cathode recited in claim 2 wherein said support cylinder is formed from a metal from the group consisting of molybdenum, molybdenum and rhenium in combination, tungsten, tungsten and rhenium in combination and tantalum.

* * * * *